United States Patent [19]

Baker

[11] Patent Number: 4,922,222

[45] Date of Patent: May 1, 1990

[54] HOLE IN ONE ALARM

[76] Inventor: Ronald D. Baker, R.R. #2, Crawfordsville, Ind. 47933

[21] Appl. No.: 213,765

[22] Filed: Jun. 30, 1988

[51] Int. Cl.[5] ..... A63B 63/00

[52] U.S. Cl. ..... 340/323 R; 273/34 R; 273/184 R

[58] Field of Search ..... 340/323 R; 273/34 R, 273/34 A, 183 R, 183 A, 184 R, 184 A, 381

[56] References Cited

U.S. PATENT DOCUMENTS

| | | | |
|---|---|---|---|
| 2,609,199 | 9/1952 | Koener | 340/323 R |
| 3,511,506 | 5/1970 | Schollick | 273/184 R |
| 3,633,007 | 1/1972 | Sanders | 273/184 R X |
| 3,655,202 | 4/1972 | Gautraud et al. | 273/184 R X |
| 4,120,496 | 10/1978 | Niina | 273/34 R |
| 4,270,751 | 6/1981 | Lowy | 273/34 R |

*Primary Examiner*—Joseph A. Orsino
*Assistant Examiner*—Brian R. Tumm
*Attorney, Agent, or Firm*—Robert A. Hirschfeld

[57] ABSTRACT

The presence of a golf ball is sensed upon a tee. After it is struck, its presence is sensed in a target cup. A Hole in One Alarm receives status information from the tee sensor and the cup sensor, and processes that information using logic and timing elements to determine that the sequence and timing conforms to a true "hole in one" event, thence activating a signal. The logic and timing elements are coupled and set so as to reject deliberate attempts to defeat the Hole in One Alarm and other event sequences not consistent with a true "hole in one" event.

8 Claims, 1 Drawing Sheet

213765

HOLE IN ONE ALARM

TECHNICAL FIELD

The invention relates to electrical monitors for sports activities.

The invention relates more particularly to an alarm for determining that a hole in one has been accomplished in the game of Golf.

PRIOR ART

In the past, conventional and miniature golf courses have offered prizes and rewards for the feat of sinking a ball into the cup in one stroke, or a "hole in one". Generally this difficult accomplishment is visually monitored and reported by players. When the prize-giver or reward-giver is remote from the site of the particular golf hole, a dispute may arise as to whether an actual "hole in one" has occurred. Miniature golf courses thrive on gadgetry and technical innovations in the obstacles and routes taken by the ball; players would enjoy an automated alarm, alerting bystanders, friends and the management of their accomplishment.

It is therefore an object of the invention to provide a Hole in One Alarm which senses the driving of a ball from tee to cup in a single stroke.

Another object of the invention is to provide a Hole in One Alarm which cannot easily be defeated so as to give false alarms.

A further object of the invention is to provide a Hole in One Alarm capable of resetting itself so as to be ready for the next player.

Still another object of the invention is to provide a Hole in One Alarm having a visual alarm indicator.

A still further object of the invention is to provide a Hole in One Alarm having an audible alarm indicator.

Yet another object of the invention is to provide a Hole in One Alarm easily installed on existing golf courses.

DISCLOSURE OF THE INVENTION

The presence of a golf ball is sensed upon a tee. After it is struck, its presence is sensed in a target cup. A Hole in One Alarm receives status information from the tee sensor and the cup sensor, and processes that information using logic and timing elements to determine that the sequence and timing conforms to a true "hole in one" event, thence activating a signal. The logic and timing elements are coupled and set so as to reject deliberate attempts to defeat the Hole in One Alarm and other event sequences not consistent with a true "hole in one" event.

BEST MODE FOR CARRYING OUT THE INVENTION

Figure 1:
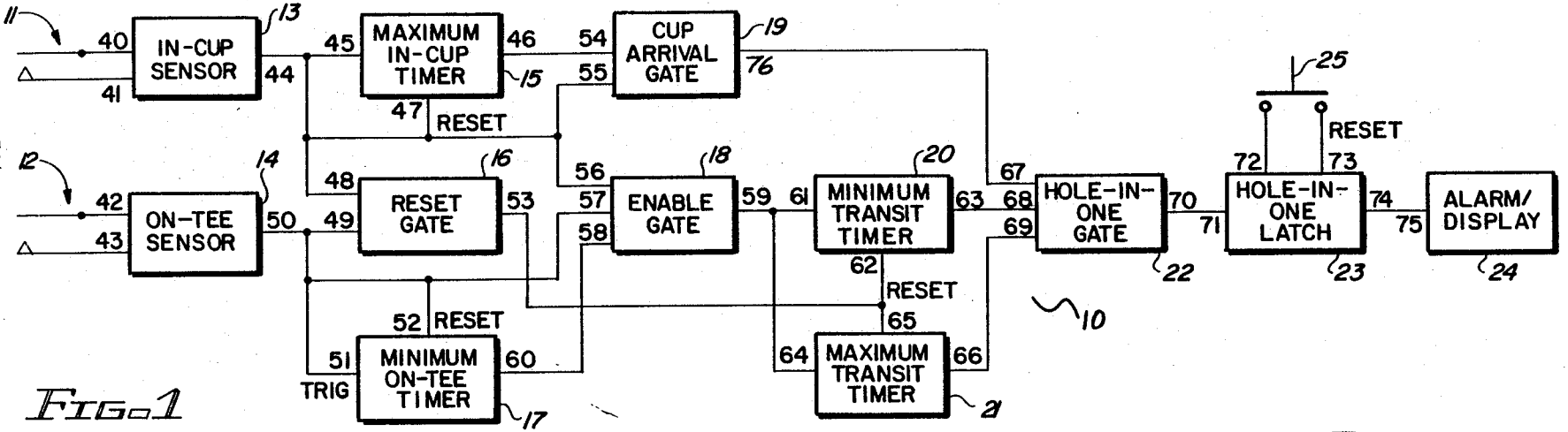
FIG. 1 is a functional block diagram of the Hole in One Alarm illustrating the interconnection of the sensors and functional blocks.

For the purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

Figure 2:
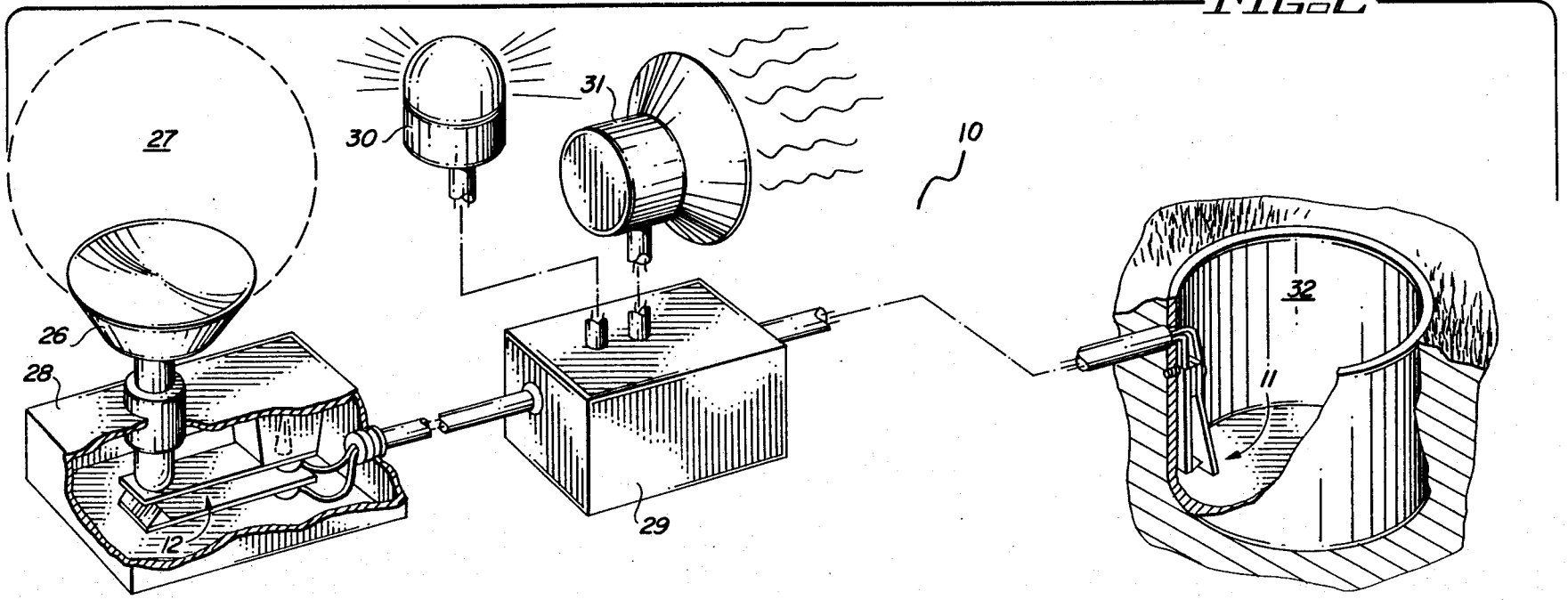
FIG. 2 illustrates a typical physical embodiment of the Hole in One Alarm of FIG. 1.

In FIGS. 1 and 2, the Hole in One Alarm is referred to generally as number 10.

Tee sensor 12 within enclosure 28 provides an electrical contact closure, as is known in the art, when a golf ball 27 is emplaced upon tee 26. No electrical contact closure occurs when ball 27 is absent from tee 26.

Cup sensor 11 within target cup 32 provides an electrical contact closure, as is known in the art, when a golf ball 27 is present within cup 32. No electrical contact closure occurs when ball 27 is absent from cup 32.

Enclosure 29 houses a group of interconnected logic gates and timing elements 13, 14, 15, 16, 17, 18, 19, 20, 21, 22, 23, which will be more fully described. Said gates and timing elements cooperatively determine that the ball 27 has first been on the tee for a minimum period, that there has been a period corresponding to permissible transit time between tee 26 and cup 32 for there to have been a legitimate "hole in one" event, during which the ball is neither on the tee or in the cup 32, that the ball is thereafter in cup 32, that the "defeat" condition of two balls occupying both cup and tee simultaneously has not occurred, and that all sequences and timings are within acceptable limits.

In the event of a sensed, legitimate "hole in one" event, the elements in housing 29 activate one or more of visual display 30, which may be a flashing light, numbers, rotating police-type lamp, or the like, and an audible alarm 31, which may be a loudspeaker, buzzer, siren, bell or the like.

In the embodiment shown, the said logic and timing elements, which may be commercially available integrated circuits as well known in the art, or alternatively may be simulated by an equivalent truth-table microprocessor system, are interconnected as follows:

Cup sensor contacts 11 drive in-cup sensor 13, which may be an amplifier or gate, to produce a "one" level output at terminal 44, which in turn drives input 45 of maximum in-cup timer 15, input 48 of reset gate 16, reset input 47 of maximum in-cup timer 15, input 55 of cup arrival gate 19, and input 56 of enable gate 18.

Tee sensor contacts 12 drive on-tee sensor 14, which may be an amplifier or gate, to produce a "one" level output at terminal 50, which in turn drives input 49 of reset gate 16, input 51 of minimum on-tee timer 17, reset input 52 of minimum on-tee timer 17, and input 57 of enable gate 18.

Output 46 of maximum in-cup timer 15 drives input 54 of cup arrival gate 19.

Output 76 of cup arrival gate 19 drives input 67 of hole-in-one gate 22.

Output 53 of reset gate 16 drives reset input 62 of minimum transit timer 20 and reset input 65 of maximum transit timer 21.

Output 60 of minimum on-tee timer 17 drives input 58 of enable gate 18.

Output 59 of enable gate 18 drives input 61 of minimum transit timer 20 and input 64 of maximum transit timer 21.

Output 63 of minimum transit timer 20 drives input 68 of hole-in-one gate 22.

Output 66 of maximum transit timer 21 drives input 69 of hole-in-one gate 22.

Output 70 of hole-in-one gate 70 drives input 71 of hole in-one latch 23. Output 74 of hole-in-one latch 23 drives input 75 of alarm/display driver 24, which may incorporate one or more of visual alarm 30 and audible alarm 31.

Reset switch 25 drives inputs 72, 73 of hole-in-one latch 23.

A more detailed functional explanation is as follows:

Maximum in-cup timer 15 produces a "one" output a period of time defined as "maximum in-cup time" after being triggered by a "one" level at its input 45, and maintains said output until reset at terminal 47 by the transition from an in-cup "one" condition to a not-in-cup "zero" condition.

Minimum on-tee timer 17 produces a "one" output at 60, a period defined as "minimum on-tee time" after being triggered by a "one" level at input 51, and maintains said output until reset at terminal 52 by the transition from an on-tee "one" to a non-on-tee "zero" condition.

Reset gate 16 produces a "one" reset signal to drive reset inputs 62, 65, whenever the condition exists of a "one" at input 49 and a "zero" at input 48; i.e., whenever a ball is on tee 26 and another ball is not in cup 32.

Enable gate 18 produces a "one" output at 59 when the following condition is met at inputs 56,57,58: the ball 27 is neither on the tee 26 nor in the cup 32, and the condition of the ball having previously according to element 17, been on the tee longer than the minimum on-tee time. Thus, Output 59 of enable gate 18 is "one" in the typical situation where the ball 27 has been just struck from the tee 26 and is in transit toward cup 32.

The inputs of cup arrival gate 19 respond as follows: a "one" level is produced at output 76 when the level at input 55 determines from output 44 that ball 27 is in the cup 32, but also at input 54 from output 46, that ball 27 has not been in cup 32 longer than the maximum in-cup time. Thus, cup arrival gate 19 displays a "one" only for the brief time from when the ball 27 arrives to the time that maximum-in-cup time is exceeded. Unless the other timing conditions set forth below for "hole-in-one" occur during this brief interval, hole-in- one-gate 70 is not activated. Thus, placing or dropping a second ball in cup 32 to defeat the system is fruitless unless done during a very precise window of time of expected arrival of the legitimately struck ball 27.

The window of expected arrival time is determined by maximum and minimum transit timers 20, 21. A "one" at output 59 of enable gate 18 triggers both timers 20, 21, which, however, are restrained in "reset" condition at inputs 62,65, if reset gate 53 detects a non-transit status.

In effect, the struck ball 27 is having a race with timers 20, 21. Outputs 63, 66 produce and hold until reset a "one" after the minimum transit time and maximum transit time respectively. Hole-in-one gate produces a "one" output at 70, when all three of the following conditions are met: Cup arrival is signaled at input 67; minimum transit time is exceeded, as signaled at input 68, but maximum transit time has not yet been exceeded at input 69 (i.e., a zero level from output 66).

If all of these conditions are met, the Hole in One Alarm concludes that a legitimate "hole-in-one" event has occurred, and output 70 of hole-in one-gate produces a "one", which triggers input 71 of hole-in-one latch 23. It is necessary to use latch 23 because the "one" at 70 is only momentary, until "maximum transit time" is exceeded. The latched output 74 drives alarm/display 24, indicating the hole in one event, and the display remains on until reset by momentary contact switch 25 through reset inputs 72,73.

If no hole in one is achieved, and the ball 27 is removed from cup 32 and thereafter another ball is placed on tee 26, the conditions for reset gate 16 to re-set or re-initialize the Alarm have been met, and no further intervention is needed to monitor the next attempt at a "hole in one".

In summary, one skilled in the art may follow the logic and timing flow described above and in the drawings, to understand that:

(a) A legitimate hole in one event, wherein ball 27 is first placed on tee 26 for more than minimum tee time, struck, and descends into cup 32 at a time intermediate minimum transit time and maximum transit time, produces a hole in one event alarm.

(b) Placing an extra ball in cup 32 will not trigger the alarm because of the logic conditions imposed by the combination of on-tee and in-cup timers 17,15 in conjunction with the cup arrival gate 19 and enable gate 18.

(c) Dropping an extra ball in cup 32 by a second person is unlikely to defeat the alarm, because such dropping must occur within the minimum and maximum transit time after the other ball is lifted from tee 27 in order to fool the alarm into believing it is one struck ball.

A typical struck ball travels at about five feet a second. The specific timings herein are set empirically upon first installing the Hole in One Alarm on a particular tee-cup layout.

Those skilled in the art will readily derive other embodiments of the invention drawn from the teachings herein. To the extent that such alternative embodiments are so drawn, it is intended that they shall fall within the ambit of protection provided by the claims appended hereto.

Having described my invention in the foregoing specification and the accompanying drawings in such a clear and concise manner that those skilled in the art may readily understand and easily practice the invention,

I claim:

1. A Hole in One Alarm for detecting the event of sinking of a ball by a golf player in a target cup with a single stroke from a remote golf tee, said event defined as a hole-in-one, said Hole in One Alarm comprising:

tee sensor means for sensing the presence of said ball upon said remote golf tee;

cup sensor means for sensing the presence of said ball in said target cup;

ball transit logic means coupled to said tee sensor means and to said cup sensor means, said ball transit logic means for determining that said ball has been sunk in said target cup after being struck from said remote golf tee;

transit timing means coupled to said ball transit logic means, said transit timing means for determining that a time sequence of events regarding emplacement, striking and sinking of said ball falls within predetermined time limits;

reset means coupled to said ball transit logic means, said reset means for placing said Hole in One Alarm in initialized condition; and signal means coupled to said ball transit logic means, said signal means for signaling that a Hole in One has been achieved.

2. The Hole in One Alarm of claim 1 wherein said tee sensor means comprises an electrical sensor for translating presence of said ball upon said remote golf tee into an electrical signal for transmission to said ball transit logic means.

3. The Hole in One Alarm of claim 1 wherein said cup sensor means comprises an electrical sensor for translating presence of said ball within said target cup into an electrical signal for transmission to said ball transit logic means.

4. The Hole in One Alarm of claim 1 wherein said ball transit logic means comprises means for determining that a sequence of events conforming to the emplacement of said ball upon said remote tee, the striking of said ball, the transit of said ball to said target cup, and the sinking of said ball in said target cup occur in a manner consistent with said hole-in-one event, thereupon transmitting confirmation of said hole-in-one event to said signal means, and further comprising means for logically excluding sequences of events inconsistent with said hole-in-one event.

5. The Hole in One Alarm of claim 1 wherein said transit timing means comprises means for determining that a sequence of events conforming to the emplacement of said ball upon said remote tee, the striking of said ball, the transit of said ball to said target cup, and the sinking of said ball in said target cup occur within time limits consistent with said hole-in-one event.

6. The Hole in One Alarm of claim 1 wherein said signal means comprises at least one of a visual alarm, and an audible alarm.

7. A Hole in One Alarm for detecting the event of sinking of a ball by a golf player in a target cup with a single stroke from a remote golf tee, said event defined as a hole-in-one, said Hole in One Alarm comprising:

tee sensor means for sensing the presence of said ball upon said remote golf tee, said tee sensor means comprising an electrical sensor for translating presence of said ball upon said remote golf tee into an electrical signal for transmission to said ball transit logic means;

cup sensor means for sensing the presence of said ball in said target cup, said cup sensor means comprising an electrical sensor for translating presence of said ball within said target cup into an electrical signal for transmission to said ball transit logic means;

ball transit logic means coupled to said tee sensor means and to said cup sensor means, said ball transit logic means for determining that said ball has been sunk in said target cup after being struck from said remote golf tee, said ball transit logic means comprising means for determining that a sequence of events conforming to the emplacement of said ball upon said remote tee, the striking of said ball, the transit of said ball to said target cup, and the sinking of said ball in said target cup occur in a manner consistent with said hole-in-one event, thereupon transmitting confirmation of said hole-in-one event to said signal means, and further comprising means for logically excluding sequences of events inconsistent with said hole-in-one event;

transit timing means coupled to said ball transit logic means, said transit timing means for determining that a time sequence of events regarding emplacement, striking and sinking of said ball falls within predetermined time limits, said transit timing means comprising means for determining that a sequence of events conforming to the emplacement of said ball upon said remote tee, the striking of said ball, the transit of said ball to said target cup, and the sinking of said ball in said target cup occur within time limits consistent with said hole-in-one event;

reset means coupled to said ball transit logic means, said reset means for placing said Hole in One Alarm in initialized condition; and signal means coupled to said ball transit logic means, said signal means for signaling that a Hole in One has been achieved.

8. The Hole in One Alarm of claim 7 wherein said signal means comprises at least one of a visual alarm, and an audible alarm.

* * * * *